US009358176B1

(12) United States Patent
Vaeth

(10) Patent No.: US 9,358,176 B1
(45) Date of Patent: Jun. 7, 2016

(54) CRUTCH UNDERARM SUPPORT

(71) Applicant: Michael Scott Vaeth, Stony Brook, NY (US)

(72) Inventor: Michael Scott Vaeth, Stony Brook, NY (US)

( * ) Notice: Subject to any disclaimer, the term of this patent is extended or adjusted under 35 U.S.C. 154(b) by 0 days.

(21) Appl. No.: 14/557,414

(22) Filed: Dec. 1, 2014

Related U.S. Application Data

(60) Provisional application No. 61/922,473, filed on Dec. 31, 2013.

(51) Int. Cl.
*A61H 3/02* (2006.01)

(52) U.S. Cl.
CPC ..... *A61H 3/02* (2013.01); *A61H 2003/0233* (2013.01)

(58) Field of Classification Search
CPC ..... A61H 3/02; A61H 3/0277; A61H 2201/1635; A61H 2201/0134; A61H 2205/025; A61H 2003/0233
USPC ..... 135/65, 68–69, 71–73, 75–76, 82
See application file for complete search history.

(56) References Cited

U.S. PATENT DOCUMENTS 1,311,664 A * 7/1919 Pearl ..... 135/73
D142,549 S 10/1945 Fink
2,417,171 A 3/1947 McGowan
D153,818 S 5/1949 Neptune
3,150,672 A 9/1964 Johnson, Jr.
3,730,198 A * 5/1973 Johnston et al. ..... 135/69
D268,456 S * 4/1983 Oleniak et al. ..... D3/10
4,405,307 A * 9/1983 Taylor ..... A61M 25/0014 604/165.01
4,625,743 A * 12/1986 Harker ..... 135/68
4,637,414 A 1/1987 Urban
5,351,701 A * 10/1994 Hsiao ..... 135/68
5,482,070 A * 1/1996 Kelly ..... 135/66
5,628,335 A * 5/1997 Free ..... 135/68
5,645,095 A 7/1997 Ramonowski
D382,104 S 8/1997 Stefanelli et al.
5,725,005 A 3/1998 Yamasaki et al.
5,848,603 A * 12/1998 Urban ..... 135/71
5,924,434 A 7/1999 Cato, III
6,314,977 B1 * 11/2001 Obitts et al. ..... 135/68
7,717,122 B2 * 5/2010 Jacobs ..... A61H 3/02 135/69
8,235,063 B2 * 8/2012 Estrada, Jr. ..... A61H 3/02 135/69
8,418,706 B2 * 4/2013 Weber ..... A61H 3/02 135/66
8,978,677 B2 * 3/2015 Roberts ..... A45B 3/00 135/66
2006/0162754 A1 * 7/2006 Karasin et al. ..... 135/85
2011/0041884 A1 * 2/2011 Hanna ..... A61H 3/02 135/66
2013/0146111 A1 * 6/2013 Gelfand et al. ..... 135/71
2013/0263901 A1 * 10/2013 Severson et al. ..... 135/72

FOREIGN PATENT DOCUMENTS

JP 06086793 A * 3/1994 ..... A61H 3/02

* cited by examiner

*Primary Examiner* — Winnie Yip
(74) *Attorney, Agent, or Firm* — Winston & Strawn LLP

(57) ABSTRACT

The invention relates to improvements in walking crutches that have an underarm support mounted on one end of a longitudinally extending leg. The improvements include providing the underarm support with symmetrical side portions having symmetrical concave, curved, smooth surfaces, and an upper concave, curved, smooth surface to provide less discomfort when contacting the user's side, more comfortable support of the user's underarm and greater ease of use of the crutch by compression of the underarm support between the user's side, arm and underarm.

14 Claims, 10 Drawing Sheets

FIG. 4
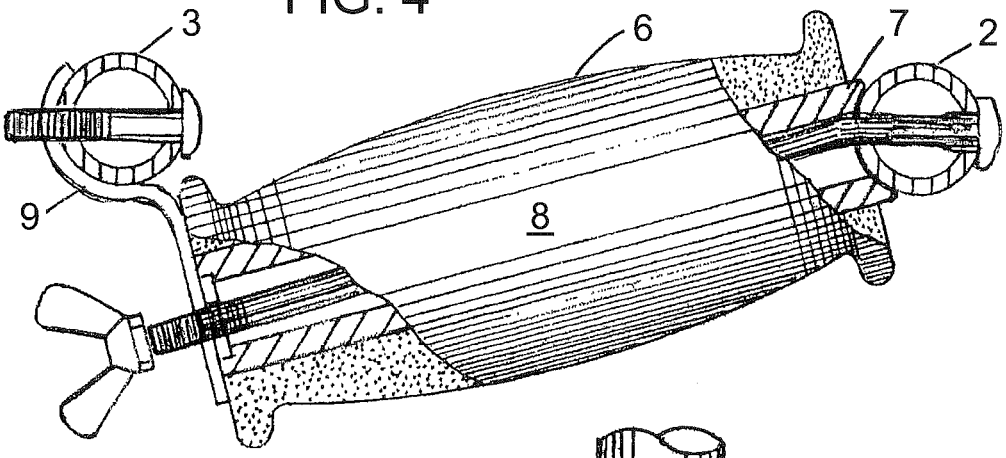
FIG. 5
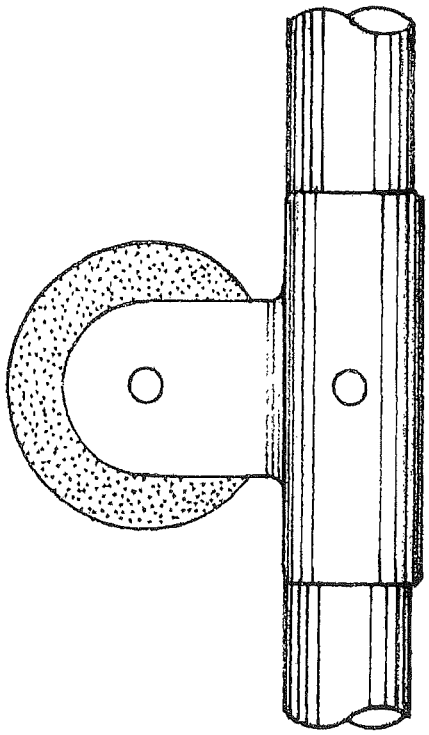
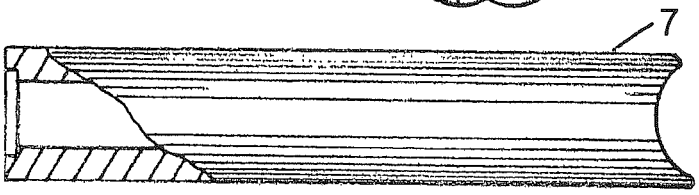
FIG. 6

FIG. 10
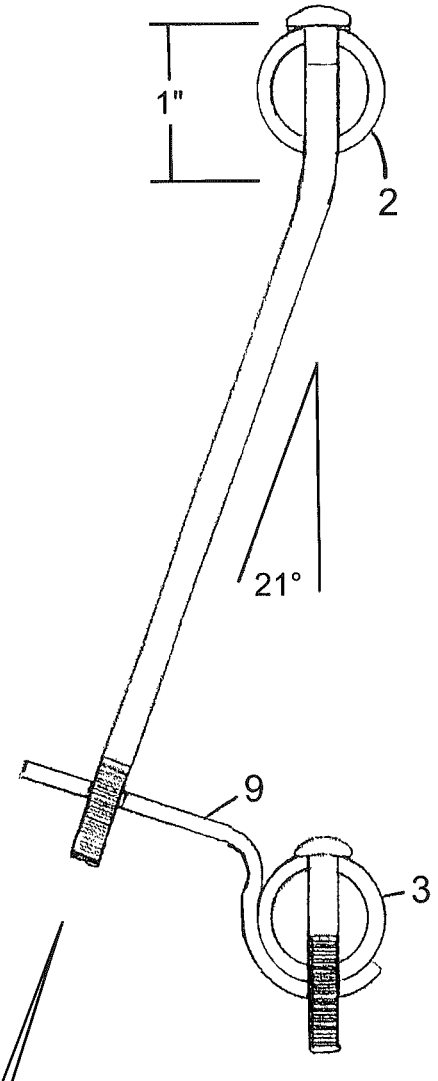
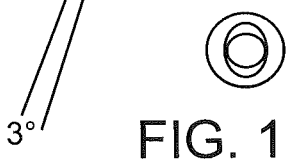
FIG. 11

FIG. 14
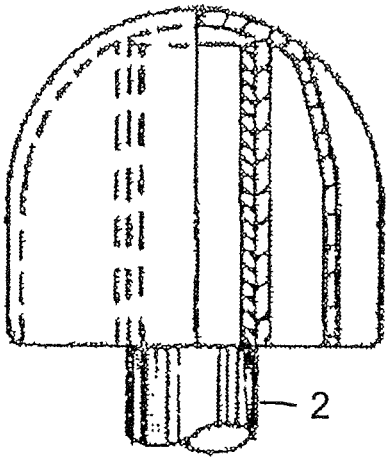
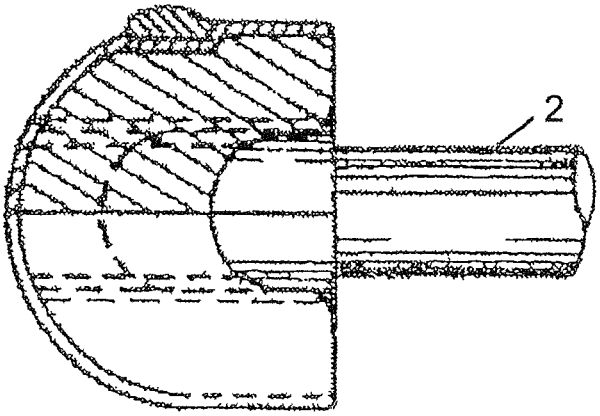
FIG. 15

CRUTCH UNDERARM SUPPORT

BACKGROUND OF THE INVENTION

The present invention is directed to walking crutches and in particular to improvements in crutches that increase the comfort and security of crutches used by individuals needing assistance in walking.

Traditional walking crutches, used by those suffering injury or other debilitation that limits the use of an individual's legs, often causes the user to get sore ribs and wrists resulting from the transition of body weight from the legs of the user to his or her hands, wrists, arms, and underarm areas. This pain and discomfort is caused for a number of reasons arising from using a device that is ill-designed to support the body weight of a user while walking.

To begin with, the bond created by the rubber pads of traditional crutches with the user's clothing causes the cloth material to abrade the skin underneath the user's arms as the underarm support moves, both back and forth as well as up and down, under the force of the user's bodyweight. This is exacerbated by the fact that the underarm support of typical walking crutches is straight and narrow where it contacts the rib cage and causes a feeling of insecurity as the crutch moves, thereby forcing the user to clamp his or her arms tightly against the crutches in an uncomfortable manner just to keep crutches secure. This makes things worse. Aside from reducing the mobility of the user's arms when gripping them tightly against one's body, this gripping of the straight and narrow crutches with the underside of the user's arm presses the abrading cloth harder against the body and intensifies the abrasive effect. Further, rigid portions of conventional crutch underarm supports create pressure points on the user's body causing pain to the rib cage and sides of the user's body.

The hand grips of traditional crutches are intended to be the primary point of support for a user, but are likewise deficient for this purpose in actual use. Traditional crutch hand grips are located in the plane of the crutch supports, resulting in interfering contact between the user's wrists and the vertical supports on the crutches. Located directly between front and rear crutch supports, the hand grip requires the user to rotate the rear portion of his or her wrist inwards in order to grasp the hand grip. This rotation forces the inner portion of the user's forearm to be pressed up against the rear vertical support of the crutch, creating a pressure point and abrasive area as the user walks. The orientation of the hand grip also results in the user's arm being aligned in a non-optimal configuration to support the user's body weight during walking. The result is pain to the forearms and wrists from use.

The detrimental physical effects of using prior art crutches cannot be underestimated. Pressure caused from the use of crutches can result in brachial paralysis from radial nerve or ulnar nerve dysfunction or injury. This extreme discomfort caused by traditional crutch underarm supports and hand grips pressing against the user's body often forces users to modify the crutch with additional padding in an attempt to reduce the pain caused by the crutches. These homemade modifications often take the form of towels, cloths, foam scraps or other readily available materials that may be haphazardly tied, taped, or otherwise wrapped around the crutch supports in an attempt to relieve the pain and discomfort from pressure created by the support. Other crutches which are currently available attempt to use padded underarm supports or sling type supports to relieve the pain, but none of these successfully eliminate pain or make them stable.

Traditional walking crutches also fail to account for realities arising from everyday use of crutches. Individuals using crutches generally have reduced mobility arising from their condition. As a result, users have limited options for resting their crutches when not in use. Oftentimes, the only place a user can place traditional crutches when not in use is resting at an angle against a nearby wall. The result is that the crutches often slide to the ground, causing embarrassment and damage to property. This may be followed by an inability of the user to now reach the crutches to pick them up due to the user's medical condition.

SUMMARY OF THE INVENTION

The invention relates to improvements in the underarm support that is mounted on one end of a longitudinally extending leg of a walking crutch. Generally, the improvement comprises providing the underarm support with symmetrical side portions having symmetrical concave, curved, smooth surfaces, and an upper concave, curved, smooth surface portion to provide less discomfort when contacting the user's side, more comfortable support of the user's underarm and greater ease of use of the crutch by compression of the underarm support between the user's side, arm and underarm. This frees the user's hands from constantly manipulating the crutch while also providing enhanced comfort when using the crutch for walking.

The improvement is typically provided by configuring the underarm support with the concave surfaces as disclosed herein. Alternatively, the improvement can be provided by a cover that is placed over a conventional underarm support, with the cover configured and dimensioned to provide the concave, curved, smooth surfaces on the side portions and the upper concave curved smooth surface portion and with an opening that is configured and dimensioned to receive the conventional underarm support therein.

Preferably, the improved walking crutch having a longitudinally extending front leg and rear leg connected to a lower leg extension; an optional but preferred hand grip mounted between the front and rear legs; and the novel underarm support of the invention mounted on the ends of the front and rear legs opposite the lower leg extension. In one embodiment of the invention, the hand grip has a front end connected directly to said front leg, and a rear end connected to said rear leg at a lateral offset from the longitudinal axis of the rear leg of a distance of between 2 inches and 5 inches such that the hand grip is angled outwardly at an angle away from the plane of the front and rear legs. The hand grip rear end is connected to an outwardly extending mounting bracket attached to said rear leg, and the connection of the hand grip rear end to the outwardly extending mounting bracket can be made laterally adjustable through the use of a slotted hole formed in the bracket, or other adjustment mechanism.

The side concave curved surface portions of the underarm support of the invention are preferably formed from a curve with a radius of between 4 inches and 6 inches, and the upper concave curved surface portion has a radius of between 5 inches and 7 inches. Rounded transition surfaces connect the side surface portions to the upper surface portion, and the outer surfaces preferably are formed from a material having a low coefficient of friction to prevent snagging or pulling on the user's clothing. Wider, bulbous ends of the underarm support prevent lateral movement of the crutch to provide a stable feel to the user.

The underarm supports can be provided with a pair of vertical indentations spaced apart at a distance equal to the distance between the front and rear legs that function to interlock with the legs of another crutch that is leaning against a wall or some other surface. The vertical indentations are formed from a curve about the longitudinal axis of the indentation that match the front and rear legs of the crutch. In addition, a pair of protruding buttons formed from a pliable material extends outwardly from the side portions of the underarm supports to support a crutch leaning against a wall and to prevent the crutch from sliding with respect to the wall.

BRIEF DESCRIPTION OF THE DRAWINGS

FIG. 4 is a partial cut-away top view of the hand grip of FIG. 3;

FIG. 5 is an end view of the hand grip of a preferred embodiment of the present invention taken along the axis of the hand grip carriage bolt;

FIG. 6. is a partial cut-away view of the hand grip center structural tube;

FIG. 10 is a detail view of the hand grip carriage bolt of FIG. 3;

FIG. 11 is a cross-sectional view of the hand grip carriage bolt of FIG. 3;

FIG. 14 is a sectional view of underarm support taken along line AA of FIG. 12;

FIG. 15 is a sectional view of underarm support taken along line BB of FIG. 12;

DETAILED DESCRIPTION OF THE PREFERRED EMBODIMENTS

Referring to the Figures, the present invention relates to improvements in the underarm support of a walking crutch, 100 that provides better support and crutch manipulation for the user than conventional underarm supports. The underarm support 1 of the invention is preferably formed from high strength molded plastic and includes an internal rib structure to provide strength and rigidity, while reducing overall weight. The underarm support 1 may also be formed from any other suitable material that will provide the necessary strength and rigidity for the intended purpose.

Figure 1:
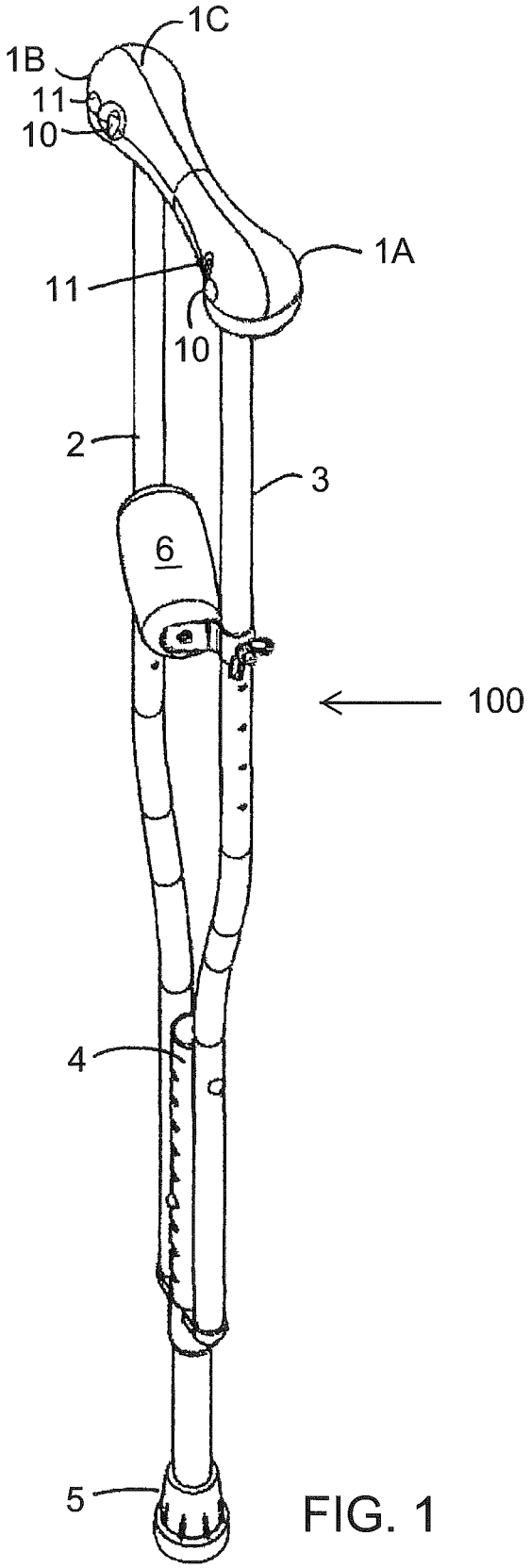
FIG. 1 is a perspective view of a crutch that includes a preferred underarm support according to the present invention.
Figure 2:
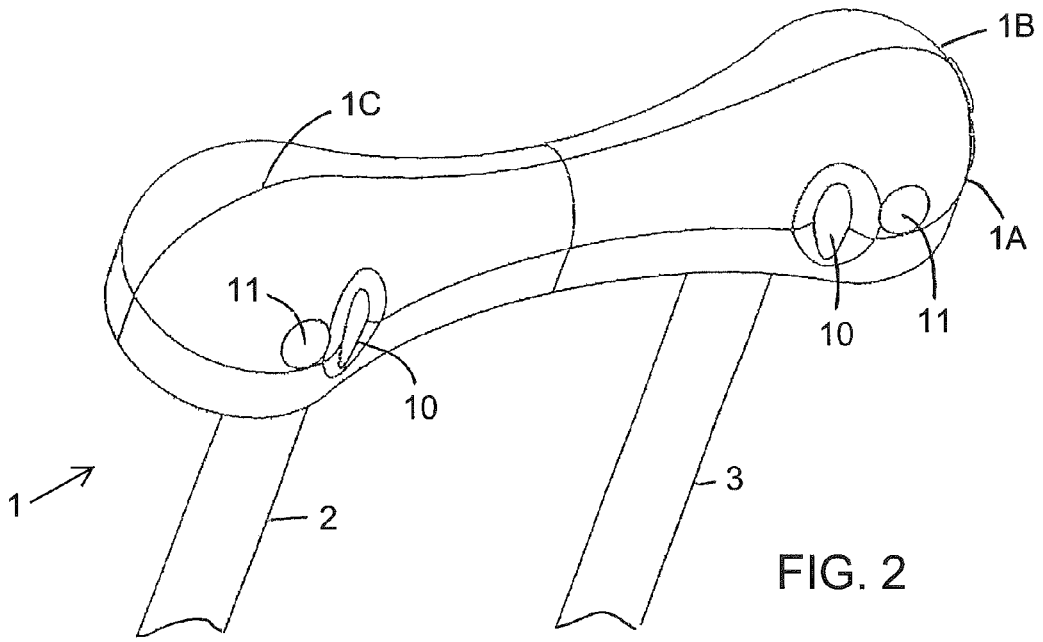
FIG. 2 is an exploded view of the underarm support of the crutch of FIG. 1.

As shown in FIGS. 1 and 2, underarm support 1 is configured on three faces with smoothly formed concave curved surface portions 1A, 1B, 1C contoured to comfortably conform with the user's body without engaging or otherwise chafing the user's clothing in a manner that would cause rubbing of the user's clothing against the skin. The ends of underarm support 1 expand outwards at their ends 1B to restrain rotational and fore-aft translational movement of underarm support 1 without the need for the user to clamp his or her arms against the body. The curved upper portion 1C provide comfortable support to the user's underarm. An internal structure for mating with the ends of front leg 2 and rear leg 3 of the crutch 100 is provided on the underside of underarm support 1 as shown in more detail in FIG. 12.

The term "smooth" as used herein is intended to mean that the support portions do not have discernable discontinuities, gaps, or other openings that provide discomfort to the user. Preferably, the surfaces of the side and upper portions will have no discontinuities. Also, the outer surface of the underarm support is made of a material that has a low coefficient of friction and this contributes to the smoothness of the surfaces and ease of use of the crutch. Plastics or elastomers having the desired hardness to provide support to the user without collapsing provide both the desired smoothness and low friction surface properties.

Looking at the underarm support from above as shown in FIGS. 1 and 2, the side surface portions 1A of the underarm support 1 are symmetrically curved inwards, with a radius of between 3" and 8", and preferably between 4" and 8". The side surface portions include a smooth transition into the wider rounded ends of the underarm support. In the direction of the top of the underarm support, the side surface portions curve towards each other, meeting at the top of underarm support 1. A minimum width of underarm support 1 of at least 1½" at the lower portion between the side surface curvatures provides sufficient bulk to the underarm support to prevent minor translation in a side-to-side direction and provide a tactile feel for the user to prevent the impression that the underarm support is loose or slipping. Together, the combination of curves 1A, 1B, 1C form a "saddle" shape to the underarm support.

Underarm support 1 has a smooth surface that permits the support to slide in relationship to clothing of the user so as not interact in a way that causes the user's clothing to rub against the skin or bunch up. The material from which the underarm support is made preferably has a low coefficient of friction that reduces interaction with clothing and the resulting abrasive nature of the clothing being rubbed against the skin. Furthermore, the minimized center portion of the underarm support and its smooth surface eliminate pressure points that would cause discomfort to the side of the body or the arm. At the same time, however, the shape of the underarm support stabilizes the top of the crutch, so the user will not have to squeeze his or her arms in order for the crutch to remain in place. Accordingly, the underarm support remains stable in position without the necessity for the user to grip the support to the body by clamping the user's arms tightly around the support.

A preferred embodiment of the improved crutch as shown in FIG. 1 includes underarm support 1 mounted on an end of front leg 2 and rear leg 3 of a crutch 100. Front leg 2 and rear leg 3 are formed from lightweight aluminum tubing appropriately sized to support loads imposed on the crutch by the user without deformation, excessive deflections, or structural failure. The front and rear legs may also be formed from other metals, alloys, composite materials, or any other material suitable for such an application, taking into account strength and weight considerations.

At the ends opposite to underarm support 1, front leg 2 and rear leg 3 are joined together with lower leg extension 4. Lower leg extension 4 may incorporate length adjustment features or mechanisms to allow the overall length of the crutch to be adjusted for variations in user size. A crutch tip 5 may be attached to the end of leg extension 4 to provide a durable non-slip surface for contact with the ground.

Figure 3:
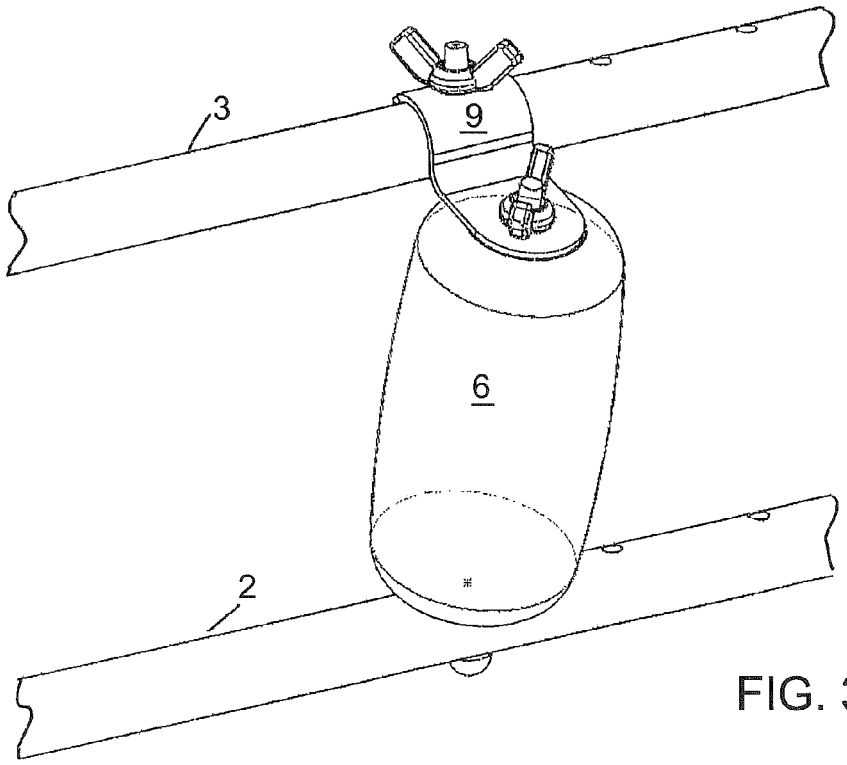
FIG. 3 is an exploded view of a the hand grip of a preferred embodiment of the present invention.
Figure 7:
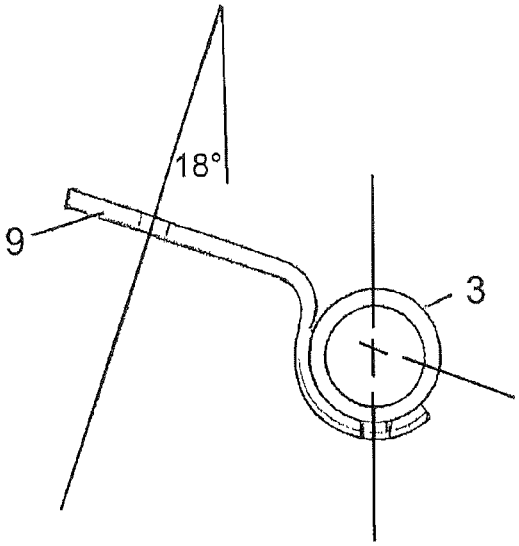
FIGS. 7 and 8 are side views of a hand grip bracket for attaching the hand grip of FIG. 4 to the crutch.
Figure 8:
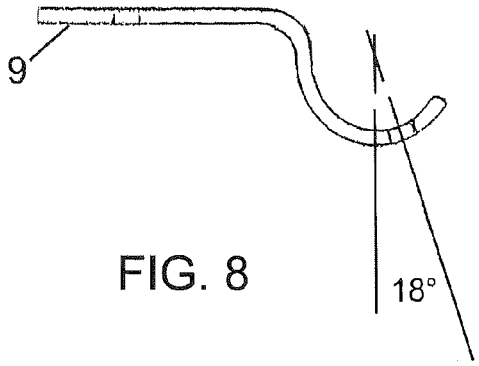
Figure 9:
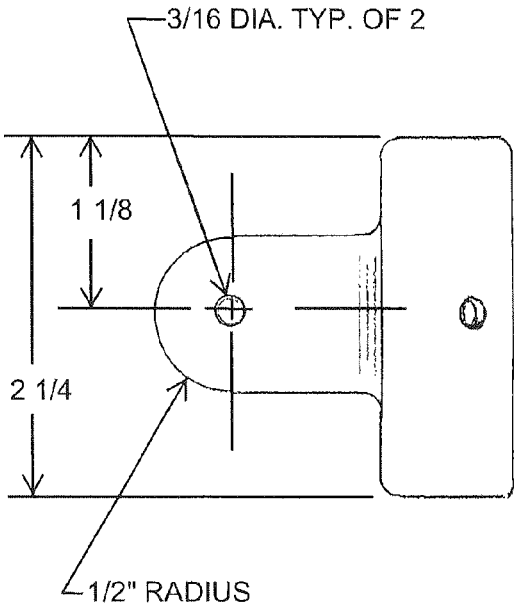
FIG. 9 is an elevation view of the hand grip bracket of FIGS. 7 and 8.

As illustrated in FIGS. 3 and 4, hand grip 6 is mounted to front leg 2 and rear leg 3 between underarm support 1 and lower leg extension 4. Hand grip 6 includes a center structural tube 7 surrounded by an outer gripping surface 8. Gripping surface 8 may be formed from a foam or other pliable material to provide an easily graspable surface that will limit or reduce pressure points exerted on the user's hands. The longitudinal axis of hand grip 6 is offset at an angle $\alpha$ from a plane connecting the centers of front leg 2 and rear leg 3, thereby positioning hand grip 6 in an orientation that will provide clearance for the user's arms and elbows away from rear leg 3 when the hand grip is held by the user. Due to the offset angle $\alpha$, the rear end of hand grip 6 is offset from the longitudinal axis of the rear leg by a distance of at least one inch to two inches. Such an orientation also allows the user's hand to grip the crutch in a more natural position than would be possible if the hand grip were mounted in the plane of front leg 2 and rear leg 3, and allows the user to align his arms to properly support his body weight when walking.

The front end of center structural tube 7 is connected directly to front leg 2 with a removable screw, but may be connected using any suitable connecting or fastening means including adhesives or other permanent connections. Use of a removable screw or other removable fastener will allow for relocation of the hand grip 6 at various holes provided along the longitudinal axis of front leg 2, thereby permitting the user to place the hand grip 6 at a comfortable position. The rear end of center structural tube 7 is connected to laterally extending hand grip bracket 9 mounted to rear leg 3, providing the necessary offset angle $\alpha$ for hand grip 6. Hand grip bracket 9 is likewise connected to rear leg 3 with a removable screw to allow for user adjustment. Hand grip bracket 9 can also be provided with a slotted hole to allow the connection to the rear end of center structural tube 7 to be adjusted outwardly as necessary to accommodate for the size and comfort of the individual user. Other types of support to position the hand grip at an offset angle from the plane of the crutch may also be utilized.

Figure 12:
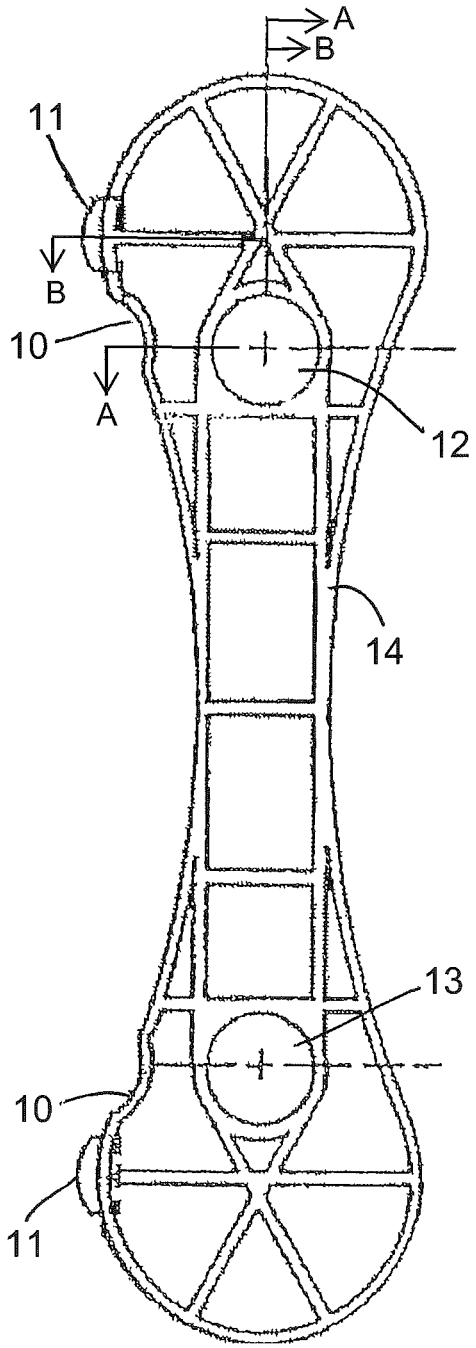
FIG. 12 is an underside view of the underarm support of FIG. 2.
Figure 13:
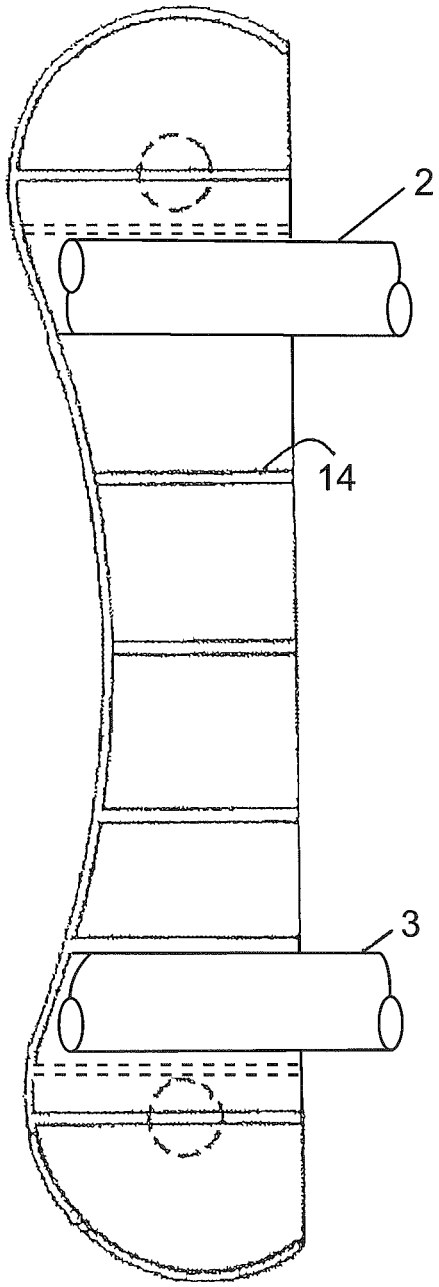
FIG. 13 is a sectional view of underarm support of FIG. 2.
Figure 16:
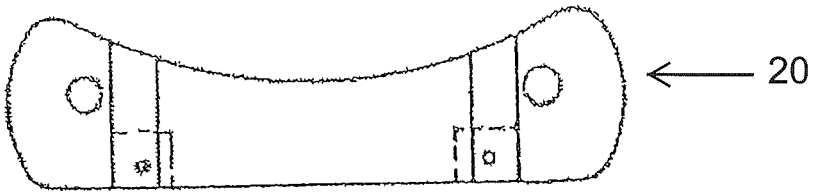
FIG. 16 is a side view of another embodiment of an underarm support according to the present invention.
Figure 17:
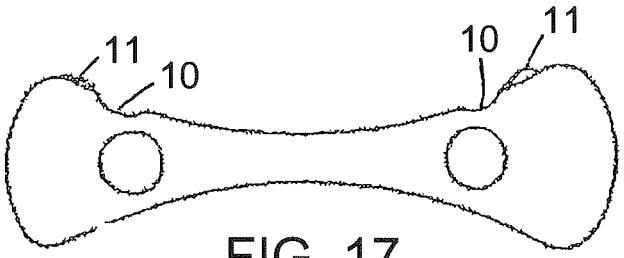
FIG. 17 is a bottom view of the underarm support of FIG. 16.
Figure 18:
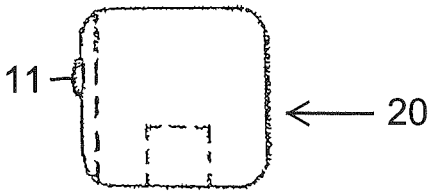
FIG. 18 is an end view of the underarm support of FIG. 16.
Figure 19:
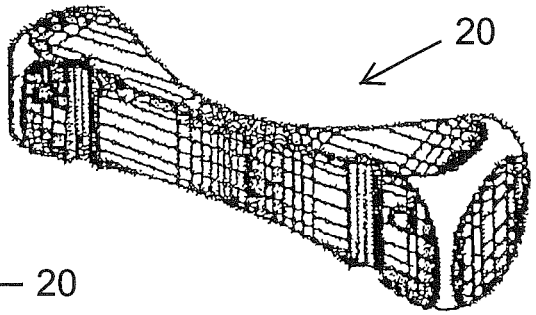
FIG. 19 is a perspective view of the underarm support of FIG. 16.

FIGS. 12 and 13 illustrate how the crutch legs are received in the structure of the underarm support. Legs 2, 3 are received in similarly configured channels 12, 13 within the underlying structure 14 of the underarm support 1. A skilled artisan can best configure this for any type of crutch but a press fit of the legs 2,3 into the channels 12, 13 is sufficient because the weight of the user of the crutch will maintain the underarm support 1 in operative association with the legs 2,3.

Figure 21:
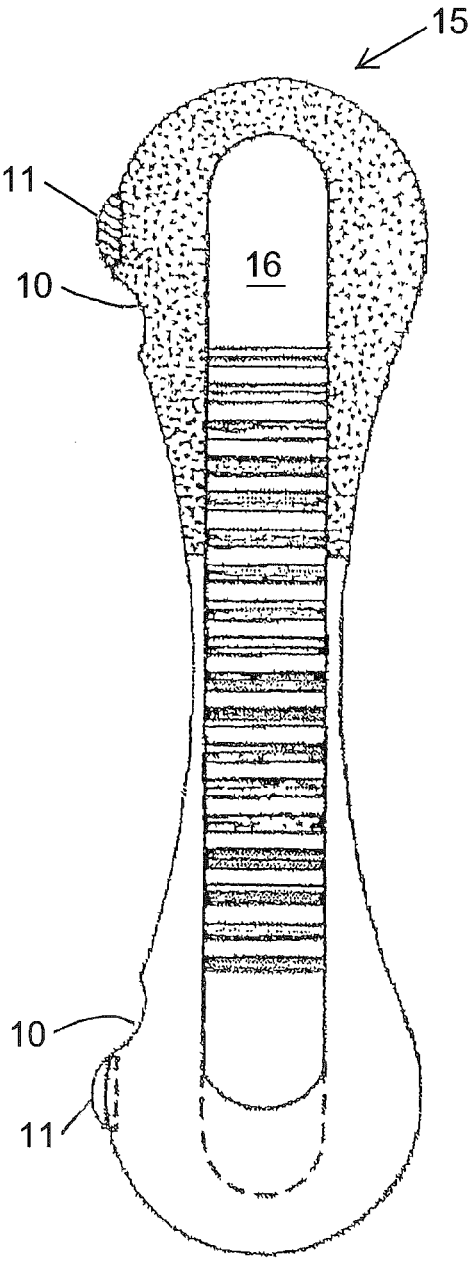
FIG. 21 is a bottom view of the underarm support of FIG. 20.
Figure 23:
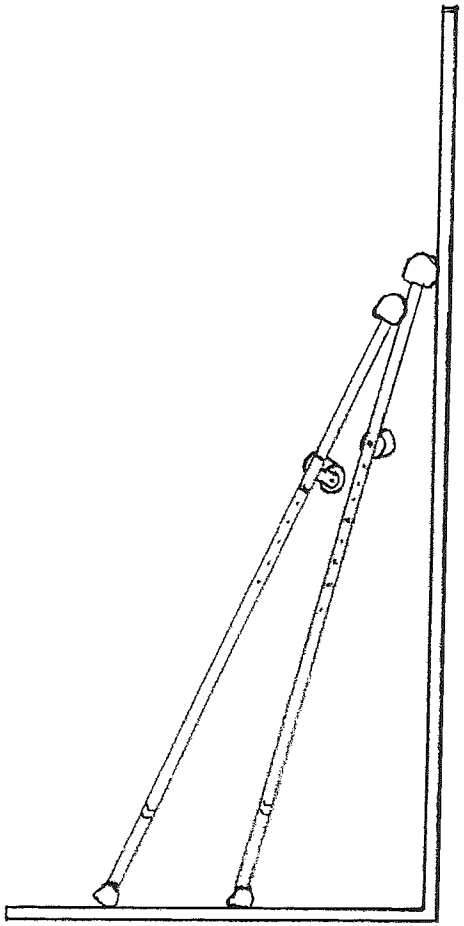
FIG. 23 is a side view of the crutches of the invention of FIG. 22 leaning against a wall.
Figure 22:
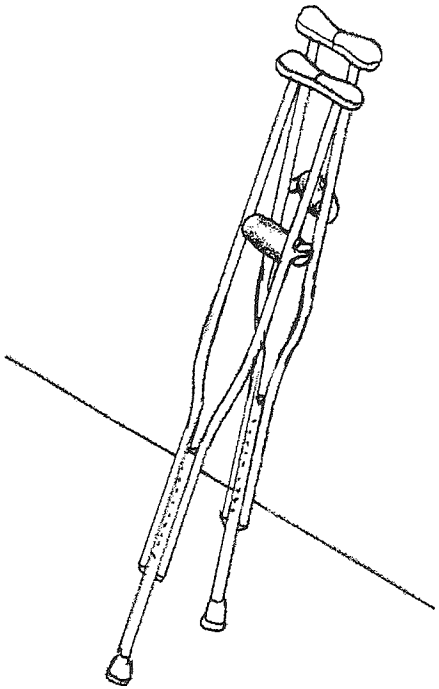
FIG. 22 is a perspective view of the crutches of the invention leaning against a wall.

As best shown in FIGS. 2, 12 and 21, another embodiment of the improved walking crutch includes groove-like vertical indentations 10 and protruding buttons 11 on side surface portions of underarm support 1, that stabilize and support the walking crutches while being rested against a wall or other surface. Each vertical indentation 10 is preferably formed from a curve about the longitudinal axis of the vertical indentation, and has a radius matching or slightly larger than the radius of the front leg 2 and rear leg 3 of the crutch. Typically a radius of ⅜" diameter is advantageous. This allows the underarm support of one crutch to interlock with the front and rear legs of another crutch when the two are positioned next to each other and placed at an angle against a wall, as shown in FIGS. 22 and 23. When the crutches are placed against a wall, protruding buttons 11 on underarm support 1 contact and engage the wall surface, acting as a support and preventing the crutches from sliding with respect to the wall and falling to the ground. The buttons 11 are typically of ½" diameter. The protruding buttons may be formed integrally with the underarm support, or may be affixed to the underarm support as a separate component. Preferably the protruding buttons are formed from rubber or other pliable material.

In use, underarm support 1 of the improved walking crutch is positioned comfortably between the body and arm of the user, without pressing the user's arm tightly against the crutch to hold it in place. As the user walks, the crutch is allowed to slide in relation to the arm of the user, but is restrained from fore-aft movement by the saddle shape of underarm support 1. Also, in situations where the user needs to have his or her hands free, the crutch can be maintained in position by compression between the user's arm, side and underarm due to the unique shape and configuration of the underarm support.

An alternative embodiment is illustrated in FIGS. 16-19, where the underarm rest is illustrated in a more rectangular configuration with rounded corners. The smooth contours and corners are maintained as in the other embodiments.

Figure 20:
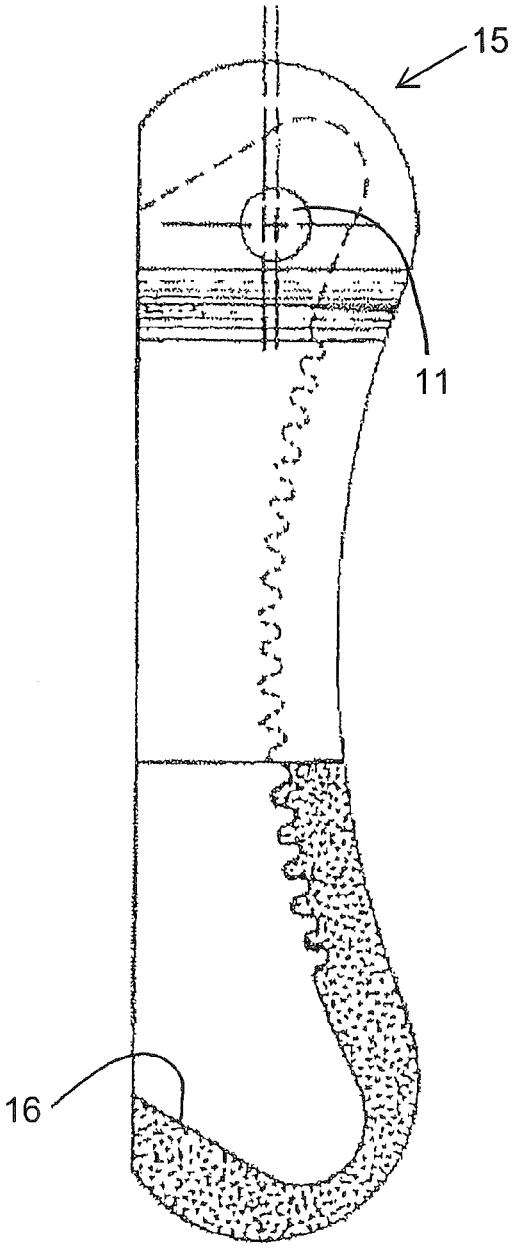
FIG. 20 is a side view, partially in section, of an underarm support according to the invention that can be placed over an existing underarm support of a conventional crutch.

In another embodiment, as shown in FIGS. 20 and 21, rather than being a unitary member, the underarm support 15 may be configured to fit over the existing underarm support structure of a conventional pair of crutches in the form of a sleeve, rather than as a unitary member directly attached to front leg 2 and rear leg 3. In this embodiment, instead of having internal structure for mating with the ends of front and rear legs of the crutch, a suitable opening 16 is provided along with internal structure to engage with the existing underarm support of conventional underarm structures and hold underarm support 15 in place.

While there has been shown and described what are considered to be preferred embodiments of the invention, it will of course be understood that various modifications and changes in form or detail could readily be made without departing from the spirit of the invention. It is therefore intended that the invention not be limited to the exact form and detail herein shown and described, nor to anything less than the true spirit and scope of the invention as defined by the claims that follow.

What is claimed is:

1. In a walking crutch comprising an underarm support mounted on one end of a longitudinally extending leg, the improvement comprising the underarm support having symmetrical side portions with symmetrical concave, and smooth surfaces curved inwards with a radius of between 4 inches and 8 inches, and an upper concave, curved, smooth surface in the direction of the top of the underarm support, having a radius of between 5 inches and 8 inches, and a wider, bulbous end transitioning from the concave curved surfaces, to provide a shape which in turn provides less discomfort when contacting the user's side, more comfortable support of the user's underarm and greater ease of use of the crutch by compression of the underarm support between the user's side, arm and underarm, and to prevent lateral movement of the crutch.

2. The walking crutch of claim 1, further comprising rounded transition surfaces connecting the side surface portions to the upper surface portion.

3. The walking crutch of claim 1, wherein the longitudinally extending leg comprises a front leg and a rear leg connected to a lower leg extension, with the underarm support mounted on the ends of the front and rear legs opposite the lower leg extension.

4. The walking crutch of claim 1, wherein the longitudinally extending leg further comprises a hand grip mounted thereon.

5. The walking crutch of claim 1, wherein the underarm support is configured and dimensioned with the symmetrical concave curved smooth surfaces on the side portions and the upper concave curved smooth surface portion.

6. The walking crutch of claim 1, wherein the underarm support is a cover that is placed over a conventional underarm support that is straight and narrow, with the cover configured and dimensioned with the symmetrical concave curved smooth surface portions on the side portions and the upper concave curved smooth surface portion on the top and further with an open portion that receives the conventional underarm support.

7. A walking crutch comprising:

a longitudinally extending front leg and rear leg connected to a lower leg extension;

a hand grip mounted between the front and rear legs; and an underarm support mounted on the ends of the front and rear legs opposite the lower leg extension, the underarm support comprising symmetrical side portions having symmetrical concave, and smooth surfaces curved inwards with a radius of between 4 inches and 8 inches, and an upper concave, curved, smooth surface in the direction of the top of the underarm support, having a radius of between 5 inches and 8 inches, and a wider, bulbous end transitioning from the concave curved surfaces, to provide a shape which in turn provides less discomfort when contacting the user's side, more comfortable support of the user's underarm and greater ease of use of the crutch by compression of the underarm support between the user's side, arm and underarm, and to prevent lateral movement of the crutch;

wherein said hand grip has a front end connected directly to said front leg, and a rear end connected to said rear leg at a lateral offset from the longitudinal axis of the rear leg of a distance of between 1 inch and 2 inches.

8. The walking crutch of claim 7, wherein said hand grip rear end is connected to an outwardly extending mounting bracket attached to said rear leg.

9. The walking crutch of claim 8, wherein the connection of the hand grip rear end to the outwardly extending mounting bracket is laterally adjustable.

10. The walking crutch of claim 9, further comprising rounded transition surfaces connecting the side surface portions to the upper surface portion.

11. The walking crutch of claim 10, wherein the outer surface of the underarm support is made of a material that has a low coefficient of friction.

12. The walking crutch of claim 11, wherein at least one of the side concave curved surfaces of the underarm support includes a pair of vertical indentations spaced apart at a distance equal to the distance between the front and rear legs, configured to interlock with the front and rear legs of another crutch to stabilize and support the walking crutch while being rested against a wall.

13. The walking crutch of claim 12, wherein the vertical indentations are groove-like vertical indentations formed from a curve about the longitudinal axis of the indentation, with a radius of between ¼ inch and ½ inch.

14. The walking crutch of claim 13, further comprising a pair of protruding buttons extending outwardly from the side portions of the underarm supports, formed from a pliable material and approximately ½ inches in diameter, wherein said buttons contact and engage a wall surface to support and prevent the crutch from sliding when the crutch is placed against a wall.

* * * * *